United States Patent [19]

Breck, Jr.

[11] Patent Number: 5,072,544

[45] Date of Patent: Dec. 17, 1991

[54] MOTORIZED PET DOOR APPARATUS

[76] Inventor: Louis W. Breck, Jr., Breck Technology, Rte. 1, Box 586, Anthony, N. Mex. 88021

[21] Appl. No.: 506,619

[22] Filed: Apr. 9, 1990

[51] Int. Cl.[5] ..... E05F 13/00

[52] U.S. Cl. ..... 49/264; 49/138; 49/168; 49/322; 49/360; 119/19

[58] Field of Search ..... 49/264, 273, 360, 168, 49/169, 322, 138, 406; 119/19, 15

[56] References Cited

U.S. PATENT DOCUMENTS

| | | | |
|---|---|---|---|
| 1,743,247 | 1/1930 | Stark | 49/360 |
| 1,921,849 | 8/1933 | Talen | 49/360 X |
| 3,039,038 | 6/1962 | Weible | 49/264 X |
| 3,821,865 | 7/1974 | Steinke | 49/360 X |
| 4,322,913 | 4/1982 | Himmer | 49/264 X |
| 4,523,408 | 6/1985 | McConnell | 49/406 X |
| 4,760,872 | 8/1988 | Hale, Jr. | 49/168 X |

*Primary Examiner*—Philip C. Kannan
*Attorney, Agent, or Firm*—Fred A. Keire

[57] ABSTRACT

An electrically powered pet door assembly for use in a home or building. Each assembly includes a frame which is secured to an exterior surface of a building, a panel slidably mounted within parallel tracks of the frame, a rotatable and translational drive assembly for vertically raising the panel, a centrifugal brake for controlling the speed of the vertical opening or closing of the panel and a treadle for activating the rotational and translational drive assembly.

18 Claims, 2 Drawing Sheets

MOTORIZED PET DOOR APPARATUS

BACKGROUND OF THE INVENTION

1. Field of the Invention

This invention relates to an electrically powered pet door apparatus, more particularly, the invention relates to an electrically powered pet door which any pet can open. The pet door is not opened by environmental factors; the invention does not harm small pets nor their limbs; and, further, this invention relates to a powered pet door which is ready to stand up to abuse without increasing the cost or complexity thereof.

2. Descriotion of the Prior Art

It is common for pet owners or owners of domesticated animals to feel inconvenienced by the dependence of their animals on them. It is inconvenient and undesirable for the pet to be dependent on the owner because the door must be opened when the pet wants to enter or leave the house. Frequently, a pet may need to leave the house early in the morning thereby disturbing and irritating the sleeping pet owner.

In order to remedy the inconvenience these various forms of the call-of-nature bring to pet owners and which are intrinsic in owning a pet, several devices are known which may be opened by animals. Generally, manual pet doors have been available consisting of a door having hinged flappers which close the door after the pet enters or exits through it by means of a spring or elastic rebound means. A typical pet door further consists of a frame mounted around an opening in a wall or entrance door of a house which has the panel or multiple panels attached by the flexible hinge means. The panel itself may be flexible or rigid depending upon the construction desired. A hinge attachment rebound means is generally mounted of the top of the opening in the wall but may be found to be mounted on one or more sides. In the elastic rebound means, the frame may be circular and the panels may be mounted circumferentially therearound forming a shutter type opening. In any case, the panel is arranged such that it tends to be self-closing, that is, by gravity or other elastic properties of the panel causing the panel or panels to close once the pet has passed through.

In addition to the above described forces used for closing, the manual pet doors of the prior art may also employ a seal or are kept in a closed position by use of magnets and/or special configurations on the periphery of the flap thereby keeping it closed. In all cases, in order for the pet to pass through the door, the pet urges or pushes on a panel(s) with its nose or head, thereby overcoming the self-closing action or other mechanical features of the panel. This method of activation presents several disadvantages.

One of the disadvantages of manual pet doors is that their self-closing force must be relatively low so that a pet of small size, weight or strength may overcome the self-closing force and open the door without difficulty. As a direct result, these easily-opened pet doors can also be opened by the forces of nature such as air pressure on a windy day. Thus, these pet doors allow cold air, rain, dirt and other elements to enter the house which further disturbs and irritates the pet owner or spouse. A drafty pet door adds to home heating losses and, frequently, discourages use during the colder winter season. This is a particular problem in the colder regions of the nation wherein the longer colder seasons pre-dominate.

Another disadvantage of a low force self-closing pet door is that it is easily opened by small animals. Other natural forces may also open and allow non-domesticated animals, reptiles or small rodents into the house or living environment of the pet owner. This easy egress becomes a problem in the warmer regions of the nation wherein the warmer seasons are longer and non-domesticated animals do not hibernate. It also concerns and affects pet owners in rural areas and in colder regions during the summer months.

Still another disadvantage of a low force self-closing pet door is that these lack the sturdiness which is necessary to endure the frequent abuses by larger pets and the forces of nature. For example, the repeated abuse of the pet door by a large dog frequently wears it out. Thus, it is desired datum to have a sturdy, more durable pet door.

Another and further disadvantage of an automatic or manual pet door is the periodic maintenance required to ensure functionability of the pet door. In automatic pet doors which have many moving parts, these components may require periodic lubrication or replacement because of the frequent use. The cost of replacement parts adds to the overall cost of the pet door which makes it more expensive over the life of the unit. For manual pet doors, of light weight construction and having a low self-closing force, the components may require replacement or reattachment which increases the inconvenience to the pet owner and overall cost of the unit.

Yet another disadvantage is the pinch hazard problem created by hinged manual pet doors. A pet door which is comprised of hinged flappers which close after the pet enters or exits, by a spring or other elastic rebound means, contains a pinch hazard to pets, especially smaller pets. A pinch point exists between a hinged flapper and the opening created in a wall or entrance door of a house wherein the elastic rebound may cause the flap and wall to jointly strike or "pinch" a paw or other extremity of the animal thereby causing injury. Furthermore, continuous injury to a pet through a pinch point tends to discourage the domesticated pet from using or opening the pet door thereby rendering it useless.

BRIEF DESCRIPTION OF THE INVENTION

The present invention provides a new and improved electrically powered pet door which combines the advantages of superior strength, weather resistance, simpler design and still greater safety for the pet.

It is an object of the present invention to provide a door apparatus that doesn't catch and injure a pet on any occasion when a pet passes through the same. Furthermore, the present invention also provides a pet door which is lowered gently by gravity under the control of a centrifugal brake, so as to eliminate any further risk of the pet being caught by a powered or uncontrolled downward movement of a pet door in closing.

An additional object of the present invention is to provide a powered pet door that combines the superior strength and weather resistance of materials which increase the durability of the pet door as a whole. Moreover, the present pet door provides an effective shield against the environmental forces such as wind, rain and cold air. Still further, the present pet door provides a powered door which may be constructed of heavier more flexible materials rather than the previous construction materials used for of manual pet doors. Furthermore, the novel pet door provides an effective shield against environmental forces and further provides an insulative lip which eliminates drafts and seals an interior room from the exterior.

It is a further object of the present invention to provide a powered pet door that is mechanically and electrically simple. The present invention does not need limit switches to control the door movement. The present invention provides effective speed reduction of a descending door while using a high speed motor which operates the opening of the door by means of, a rod, cord and pulley system, and, furthermore, without a need for using complex gears.

Other features, benefits and advantages according to the present invention will become apparent from the following detailed description of an illustrated embodiment shown in the accompanying drawings.

DETAILED DESCRIPTION OF THE DRAWINGS AND DESCRIPTION EMBODIMENT OF THE PRESENT INVENTION

Figure 1:
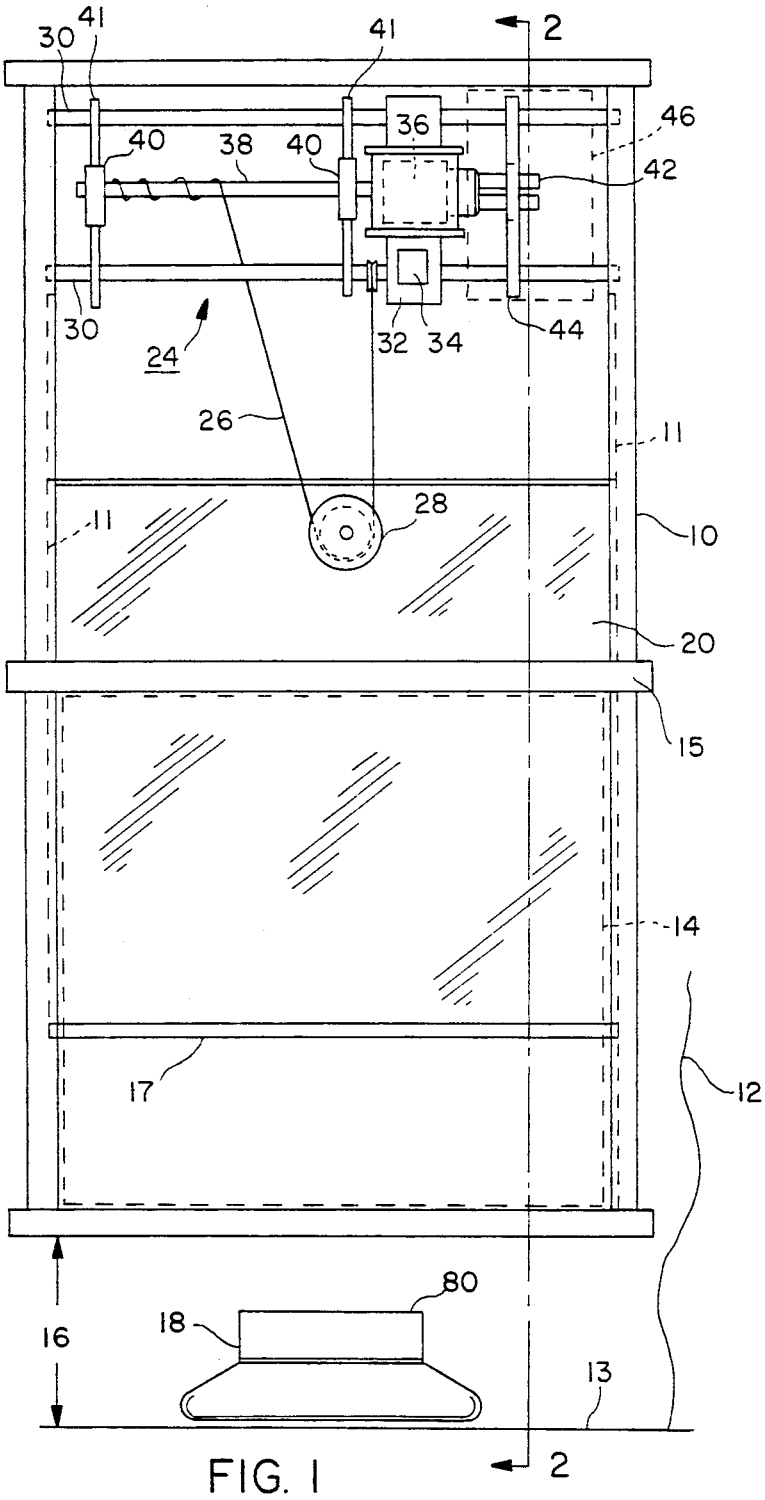
FIG. 1 is a schematic front-view of the embodiment of the present invention.

In FIG. 1, an electrically powered pet door apparatus according to an embodiment of the present invention will now be described. The pet door apparatus contains a frame 10 having the parallel tracks or slots 11 cut into each interior surface of the vertical sides of the frame. The frame 10 is mounted on a surface 12 which may be any smooth inside or outside surface of a partition leading to the outside in any building structure such as an exterior wall, door, garage door, garage, etc. Frame 10 may be fastened to the surface 12 by means of any suitable fasteners, i.e. such as screws. Prior to mounting the frame 10, a panel aperture 14 (represented by a dotted line) is cut into the exterior surface 12 at a height or a distance from the floor 13. The height 16 is calculated to be convenient for the individual pet which is contemplated for its passing through the panel aperture 14 exiting to the outside. Within the height 16 and above the floor 13, a treadle 18 is mounted on surface 12. Another treadle, not shown, is mounted in a corresponding position on the inside or opposite to the exterior surface 12.

Also in FIG. 1, a panel member 20 is shown which slides vertically in the parallel tracks 1 cut into the generally planar frame 10. The panel member 20, shown in a partially open position, is free to travel the full range of the panel aperture 14 or to a maximum height which is near the height of cross-bar 15. The cross-bar 15 spans the width of the frame 10 providing both stability to the frame and an insulative seal operating jointly with a lip 22, shown in FIG. 2, when the panel aperture 14 is in its closed position.

The panel 20 is raised and lowered by a rotational and translational drive unit 24. The rotational motion of the rotational system comprised rotating of drive shaft 38 which decreases the overall length of the line cord 26 wrapped around a pulley 28 transmitting the mechanical rotational power into a vertical raising motion or translational motion, thus raising the panel 20.

Figure 5:
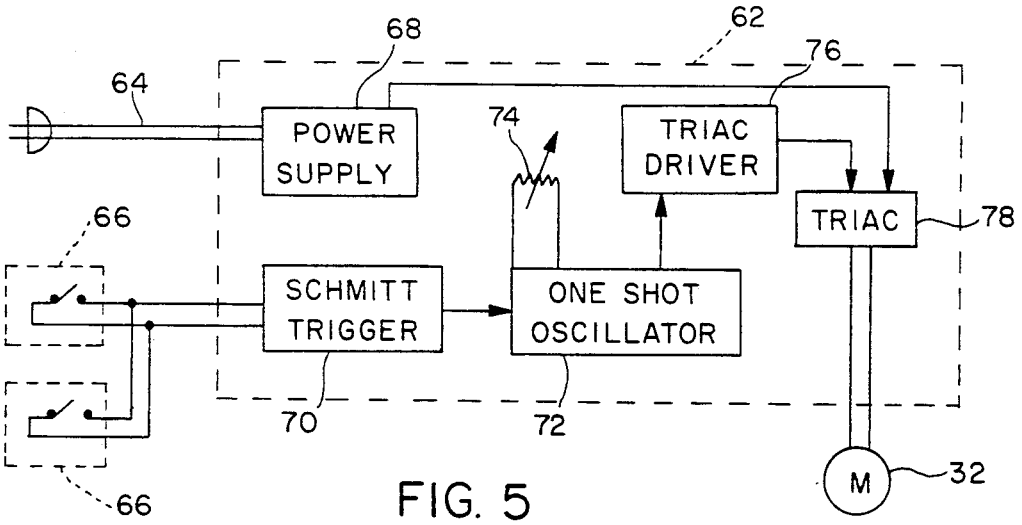
FIG. 5, is a schematic diagram of the electronic control system according to an embodiment of the present invention.

The rotational and translational drive unit 24 is comprised of a shaded pole motor 32 which rotates a driveshaft 38 with the line cord or wire 26 attached thereto. The shaded pole motor 32 is positioned by support rods 30 and attached thereto by field assembly 34. The driveshaft 38 is positioned between two ball bearing elements 40 and ball bearing supports 41. The rotational and translational drive unit further comprises a centrifugal brake 42 positioned within a brake stator 44 wherein the centrifugal brake 42 is connected to the rotor 36 of the shaded pole motor 32. The rotational and translational drive unit 24 further has a housing 46 (represented by a dotted line) which houses the electrical circuit board 62, as shown in FIG. 5.

Figure 2:
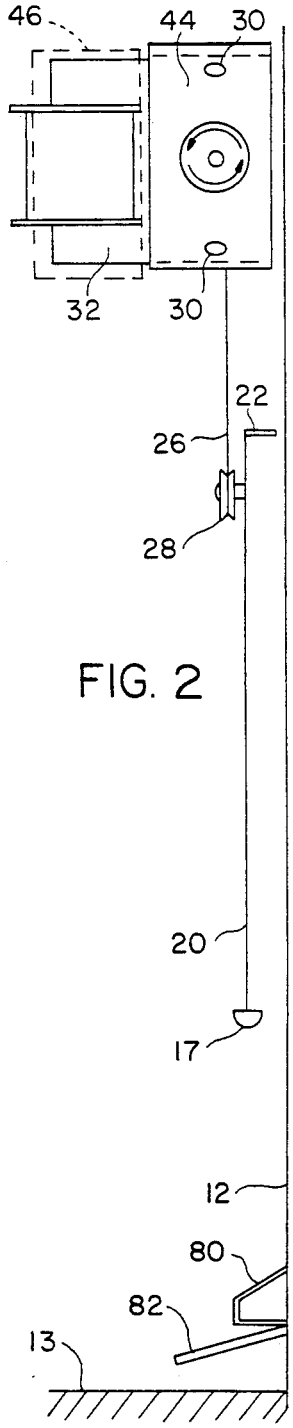
FIG. 2, taken along the lines 2—2 in FIG. 1, is a schematic side-view of the powered door assembly according to the embodiment of the present invention.

Referring now to FIG. 2, the panel 20, as raised or lowered by the pulley 28 and line cord 26, further comprises a base 17 and a lip portion 22. The panel 20 may be made from a durable and rugged material such as sheet-metal because, unlike the flapper type of pet door, the panel 20 is only raised vertically and is restrained from all other motion. The base 17 may be rounded or constructed such that there are no sharp edges to create any pinch point. The lip portion 22 operating in conjunction with the cross-bar 15 forms an effective seal or insulative barrier to the outside, external elements.

The treadle 18 consists of a pedal plate 82 and bracket 80 which operate to generate a signal which ultimately operates to open the panel 20. The exterior surface 12 has an individual treadle 18 placed at each of the inside and the outside surface allowing for entry and exit. When a pet desires to pass through the panel aperture 14, the pet depresses one of the pedal plates 82 connected to the treadle bracket 80 by means of suitable fasteners such as hinges. Also associated with the treadle 18 is an electrical switch assembly 66, discussed below in FIG. 5, and which is further electronically connected to the electrical housing 46. By depressing the pedal plate 82 the domestic animal closes the electrical switch 66 sending a signal to the circuit board 62, both shown in FIG. 5, which responds in causing the panel 20 to be raised vertically.

Also, as seen in the rotational and translational drive unit 24 in FIG. 1, the support rods 30 attached to frame 10 are an integral part of the structural framework. The shaded pole motor 32, which may be of the type commonly used such as in household fans and blowers, is attached to the support rods 30 by the field assembly 34. The ball bearing elements 40 are support by the ball bearing supports 41, which are connected to the support rods 30 and further position and align the driveshaft 38, having line cord 26 attached thereto, and the rotation of the shaded pole motor 32. In an alternate embodiment, the rotational and translational drive unit may further be encased by a housing, not shown, which would extend from the top of the frame 10 to the cross-bar 15 concealing from the sight these elements.

Referring to FIG. 1, the speed reduction and control of the powered pet door assembly are achieved by the several novel features of the rotational and translational drive unit 24. The diameter of driveshaft 38 is small, approximately 3/16 inch, and it coils the line cord 26 providing increased turns of the line cord therearound thus allowing still greater control of the vertical movement of panel 20. The second feature results from the pulley 28 and line cord 26 arrangement, wherein a 2:1 ratio of the pulley to driveshaft diameter translates rotational power into translational drive smoothly, further controlling the vertical movement. The third novel feature results from the improved centrifugal braking means 42 which provides essential speed regulation when the shaded pole motor 32 is being driven forwards under power and backwards by the weight of descending panel 20.

Figure 3:
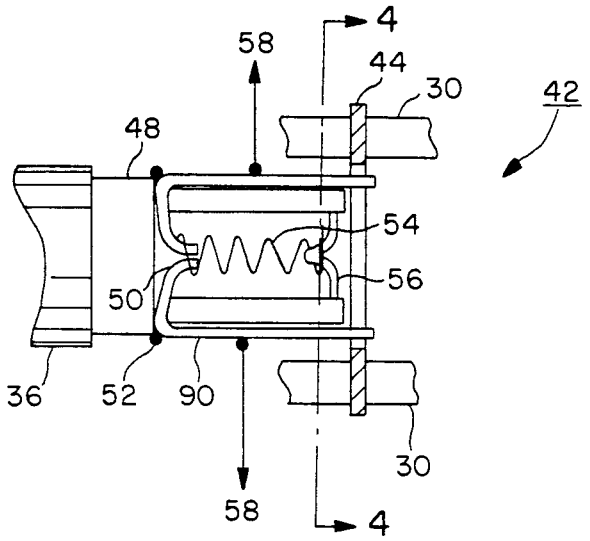
FIG. 3, is a schematic front-view of the centrifugal brake according to the embodiment of the present invention.
Figure 4:
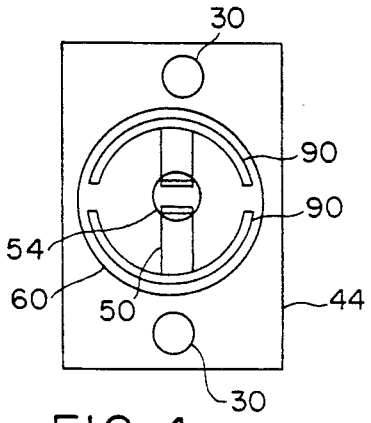
FIG. 4, taken along lines 4—4 of FIG. 3, is a schematic side-view of the centrifugal brake according to an embodiment of the present invention.

Referring to FIGS. 3 and 4, the features of the centrifugal brake 42 will now be described. A base body 48 is rigidly fastened to rotor 36 which is rotated by the shaded pole motor 32, shown in FIG. 1. The base body 48 is equipped with slots, not shown, for inserting each of two metal brake shoe 90 having curved brake tabs 50. A coil spring 54 engages and fits over the ends of brake tabs 50, loosely holding them together. A wire clip 56 fixed to the base body 48 contains the coiled spring 54 and forces it or causes it to push brake tabs 50 against the base body 48. More specifically, as shown in FIG. 3, the brake shoes 90 are held in an engaged position by the joint, yet opposite, forces exerted between the stationary wire clip 56 and the base body 48 wherein the coiled spring can only push both brake tabs 50 against the base body 48.

In FIG. 4, once the centrifugal brake 42 is engaged, either in raising under power or lowering due to weight of the panel 20, shown in FIG. 1, the uncoiling of the line cord 26 rotates the driveshaft 38 creating a centrifugal force 58 pulling on the brake shoes 90 tending to force them apart in the outward direction. The brake shoes 90 pivot around pivot point 52 while undergoing the centrifugal force 58. However, the centrifugal force 58 is not unbridled because the brake shoe 90 are restrained by an engaging hole 60 of a brake stator 44. The brake stator 44 is comprised of a flat plate of friction generating material, i.e. such as fiberboard. The engaging hole 60 has a diameter which is slightly larger than the diameter of the brake shoe 90 assembly such that there is clearance between the brake shoes 90 and the engaging hole 60, however, only that which is necessary. The centrifugal force 58 exists whether the panel 20 is being raised or lowered and is resisted by the coil spring 23, until at a certain predetermined and calibrated speed, this resistance is overcome and the brake shoes 90 pivot outwardly contacting the innersurface of the engaging hole 60. As a result, there is a speed limiting action in both directions of rotation.

Referring to FIG. 1, the ball bearing elements 40 supported on the ball bearing supports 41 accurately position the driveshaft 38 and allows it to rotate with relatively low friction. Because of the low friction of the ball bearing elements 40, little or no maintenance is required for the life of the unit because no components require periodic lubrication. Furthermore, these components of the present invention do not require great precision, special manufacturing methods or costly materials. Thus the present invention is of a simple construction which reduces assembly time, labor, individual component costs, and overall production costs.

Referring to FIG. 5, the circuit diagram of the circuit board 62 will now be described. The circuit board 62 is contained within the electrical housing 46, shown in FIG. 1, which may consist of a metal box or the like. The electrical circuit comprises a power cord 64 applying external power to the power supply 68, typically furnishing 115 volts AC power. The circuit further consists of the electrical switch assembly 66, a trigger means 70, a one-shot oscillator 72 having a potentiometer 74, a triac driver 76, a triac 78 and a motor 32. The power supply 68 supplies power to the motor 32 and other circuits on the board.

Referring to FIGS. 2 and 5, the electrical switches 66 close when the treadle plate 82 is depressed by the pet. The closed switch 66 is adapted to supply a relatively low voltage to the input of the Schmitt trigger 70, and it may be supplied by either of the electrical switches 66, on either side of the exterior surface 12. Ideally the input to the Schmitt trigger 70 should be a high impedance circuit which conducts little current, thereby eliminating any shock hazard associated with the electrical switches 66 and providing further safety for the animal.

Upon detecting a depressed treadle plate 82, the Schmitt trigger 70 output supplies a signal to the input of the one-shot oscillator 72 which generates an electrical pulse of a predetermined length corresponding to the desired opening period of the plate 20, shown in FIG. 1. The length of the pulse from the one-shot oscillator 72 may be varied by the potentiometer 74. The output of the one shot oscillator 72 is supplied to the triac driver 76 which converts and supplies a gate drive or triac pulse signal to the input of the triac 78. The triac 78 which operates as a switch and is turned on by the triac pulse, supplies AC power as output. The AC power is supplied from the power supply 68 through the triac 78, now open, to the shaded pole motor 32 causing the panel 20 to open. The motor 32 remains in the state on for the duration of the pulse, and the plate 20 is raised until it reaches the rotational and translational drive assembly 24, wherein it stalls until the motor stops and the plate 20 begins to fall slowly. This simple construction insures the animal safety, low maintenance cost and low production costs.

Although a preferred embodiment of the present invention has been described in detail herein, it is to be understood that this invention is not limited to that precise embodiment, and that many modifications and variations may be achieved by one skilled in the art without departing from the invention as defined by the appended claims.

I claim:

1. An apparatus for an electrically powered pet door, having an opened state and closed state, said apparatus comprising frame means for securing to an exterior surface, said frame means includes a plurality of parallel tracks and a crossbar for a seal and a stop, panel means slidably positioned within said parallel tracks of said frame for exposing in said opened state a panel aperture through said exterior surface, said panel means includes a pulley for hoisting said panel means, drive means interconnected with said pulley for said panel means for vertically positioning said panel means in said opened and closed state brake means interconnected to said drive means for regulating the vertical positioning of said panel means, and treadle means for activating said drive means.

2. An apparatus as set forth in claim 1 wherein said panel means is of a durable material.

3. An apparatus as set forth in claim 1 wherein said panel means has a flexible lip.

4. An apparatus as set forth in claim 1 wherein said panel means has a base made of a durable material and includes rounded edges thereon.

5. An apparatus as set forth in claim 1 wherein said drive means includes a motor and a driveshaft having a first end of a line cord attached to said drive shaft and run over said pulley for said panel means and a second end of said line cord permanently secured to said frame means, and wherein said motor rotatably turns said driveshaft and shortens said line cord when lifting said panel means.

6. An apparatus as set forth in claim 1 wherein said drive means includes a trigger means, an oscillator means, a signal amplifier means and a gate means for generating a pulse of a predetermined length for said drive means upon activation of said treadle means.

7. An apparatus as set forth in claim 6 wherein said trigger means includes a Schmitt trigger.

8. An apparatus as set forth in claim 6 wherein said oscillator means includes a one-shot oscillator.

9. An apparatus as set forth in claim 8 wherein said oscillator means includes a potentiometer for varying a pulse length generated by said one-shot oscillator.

10. An apparatus as set forth in cliam 6 wherein said signal amplifier means is a triac driver.

11. An apparatus as set forth in cliam 6 wherein said gate means is a triac.

12. An apparatus as set forth in claim 1 wherein said brake means includes a centrifugal brake.

13. An apparatus as set forth in cliam 1 wherein said treadle means includes an electrical switch assembly for activating said drive means upon closure.

14. An apparatus for an electrically powered pet door, having an opened state and a closed state, said apparatus comprising a frame including on two or more sides a set of parallel tracks, a cross-bar positioned horizontally across said frame and secured thereto, and said frame being positioned over a panel aperture, a panel member positioned within said frame between said parallel tracks including a fixed lip portion at an upper edge, a base at a bottom-edge sealing said panel aperture when said pet door is in said closed state, and a pulley having a line cord of two ends run over said pulley one end of which is secured to said frame, a rotational and translational drive unit includign a driveshaft having the otehr end of said line cord attached thereto for winding the other end of said line cord therearound, a centrifugal brake driven by said rotational translational drive unit, interconnected thereto by a base body and a rotor of said drive unit, said centrifugal brake functionally engaged with two or more brake shoes and an engaging hole within a brake strator, a treadle electrically connected to said rotational and translational drive unit for raising and lowering said panel member with said frame.

15. An apparatus as set forth in claim 14 wherein said panel member is of a durable material.

16. An apparatus as set forth in claim 14 wherein said rotational and translational drive unit includes a shaded pole motor, rotatably driving said driveshaft, and said motor being controlled by a gate.

17. An apparatus as set forth in claim 16 wherein said rotational and translational drive unit includes an electronic trigger coupled to an oscillator and triggerable to supply a signal to said oscillator and drive the same, said oscillator coupled to gate driver to supply a signal to said gate driver for a length of time as determined by a potentiometer, said gate driver coupled to said gate to open said gate for said predetermined length of time, and said gate coupled to said drive means to drive said drive unit.

18. An apparatus as set forth in cliam 14 wherein said treadle includes a treadle plate and a bracket for attaching to an exterior wall surface, a treadle controllable trigger, and an electrical switch coupled to said trigger of said rotational and translational drive unit.

* * * * *